US010082374B2

(12) United States Patent
Marshall

(10) Patent No.: US 10,082,374 B2
(45) Date of Patent: Sep. 25, 2018

(54) MAGNETIC AMMUNITION FOR AIR GUNS AND BIODEGRADABLE MAGNETIC AMMUNITION FOR AIRGUNS

(71) Applicant: James Nicholas Marshall, Vista, CA (US)

(72) Inventor: James Nicholas Marshall, Vista, CA (US)

( * ) Notice: Subject to any disclaimer, the term of this patent is extended or adjusted under 35 U.S.C. 154(b) by 0 days.

(21) Appl. No.: 15/195,967

(22) Filed: Jun. 28, 2016

(65) Prior Publication Data

US 2017/0082410 A1 Mar. 23, 2017

Related U.S. Application Data

(63) Continuation-in-part of application No. 14/449,550, filed on Aug. 1, 2014, now Pat. No. 9,885,536.

(51) Int. Cl.

| | |
|---|---|
| ***F42B 12/74*** | (2006.01) |
| ***F42B 12/76*** | (2006.01) |
| ***F42B 6/10*** | (2006.01) |
| *F41B 11/50* | (2013.01) |

(52) U.S. Cl.

CPC ..... *F42B 6/10* (2013.01); *F42B 12/74* (2013.01); *F42B 12/76* (2013.01); *F41B 11/50* (2013.01)

(58) Field of Classification Search

CPC .... F42B 6/00; F42B 6/006; F42B 6/10; F42B 8/14; F42B 8/16; F42B 12/36; F42B 12/40; F42B 12/72; F42B 12/74; F42B 12/745; F42B 12/76; F42B 12/78; F42B 12/80

USPC ..... 102/513, 517, 518

See application file for complete search history.

(56) References Cited

U.S. PATENT DOCUMENTS

| | | | | |
|---|---|---|---|---|
| 2,592,434 | A * | 4/1952 | Krasnow | E21B 47/044 102/513 |
| 2,827,577 | A | 3/1958 | Kimberlin, Jr. et al. | |
| 3,161,410 | A | 12/1964 | Cunningham | |
| 3,913,554 | A * | 10/1975 | Pitcher | F41B 11/51 124/44.6 |
| 4,222,330 | A * | 9/1980 | Krystyniak | F42B 5/02 102/430 |
| 4,386,598 | A * | 6/1983 | Blaser | F41B 3/005 124/21 |
| 4,458,577 | A | 7/1984 | Fisher et al. | |
| 4,471,699 | A | 9/1984 | Turco et al. | |
| 4,565,571 | A | 1/1986 | Abbaschian | |

(Continued)

FOREIGN PATENT DOCUMENTS

| | | | |
|---|---|---|---|
| JP | 2002-277198 | A | 9/2002 |
| JP | 2007-078208 | A | 3/2007 |
| RU | 2 410 633 | C1 | 1/2011 |

*Primary Examiner* — Bret Hayes

(74) *Attorney, Agent, or Firm* — Birch Stewart Kolasch & Birch, LLP

(57) ABSTRACT

A round for a magnetically chambered air gun has a magnetically influenced portion and a non-magnetically responsive portion, as well as an exterior shell and an interior. The interior may be hollow, solid, or filled with liquid. Any part of the invention may be the magnetically responsive portion: the shell, the interior, the solid or liquid core and so on. The round may advantageously be spherical, and may include an actual magnet itself as opposed to merely being magnetically responsive. Magnetic materials may be impregnated into a non-magnetic portion such as a plastic shell. The shell may be of multiple part construction with a snap together design.

17 Claims, 14 Drawing Sheets

(56) References Cited

U.S. PATENT DOCUMENTS

| | | | | |
|---|---|---|---|---|
| 4,625,618 | A | 12/1986 | Howanick | |
| 5,003,884 | A | 4/1991 | Nissl et al. | |
| 5,007,348 | A | 4/1991 | Pinson | |
| 5,024,137 | A * | 6/1991 | Schroeder | F41B 6/00 124/3 |
| 5,095,831 | A * | 3/1992 | Mauzy | F42B 7/046 102/448 |
| 5,105,713 | A * | 4/1992 | Wirgau | F42B 6/006 102/517 |
| 5,191,164 | A | 3/1993 | Hawke et al. | |
| 5,275,083 | A | 1/1994 | Hawke et al. | |
| 5,763,812 | A | 6/1998 | Collins | |
| 6,553,913 | B1 * | 4/2003 | Wardlaw | F41A 21/32 102/501 |
| 7,526,988 | B2 | 5/2009 | Elder | |
| 7,886,668 | B2 | 2/2011 | Hugus et al. | |
| 8,402,959 | B1 | 3/2013 | Nungester | |
| 8,578,922 | B1 | 11/2013 | Granger | |
| 8,783,185 | B2 | 7/2014 | Jacobsen et al. | |
| 2006/0254450 | A1 | 11/2006 | Herbelin | |
| 2007/0006770 | A1 | 1/2007 | Herrlinger | |
| 2007/0261587 | A1 | 11/2007 | Chung | |
| 2009/0013893 | A1 | 1/2009 | Vasel | |
| 2010/0034686 | A1 * | 2/2010 | Peterson | C22C 1/045 419/11 |
| 2011/0214653 | A1 * | 9/2011 | Lyon | F41B 5/14 124/23.1 |
| 2012/0216697 | A1 | 8/2012 | Jacobsen et al. | |

* cited by examiner

Figure 2
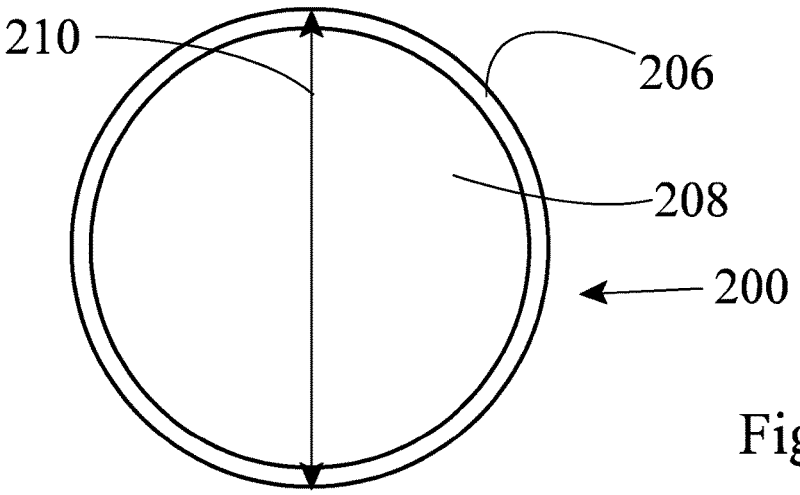
Figure 3
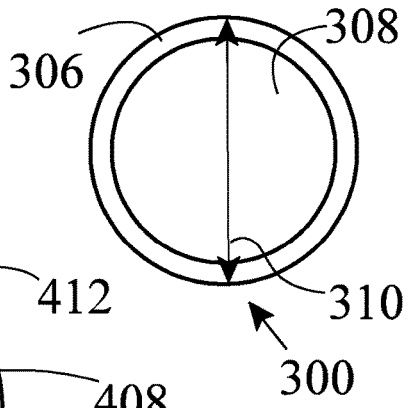
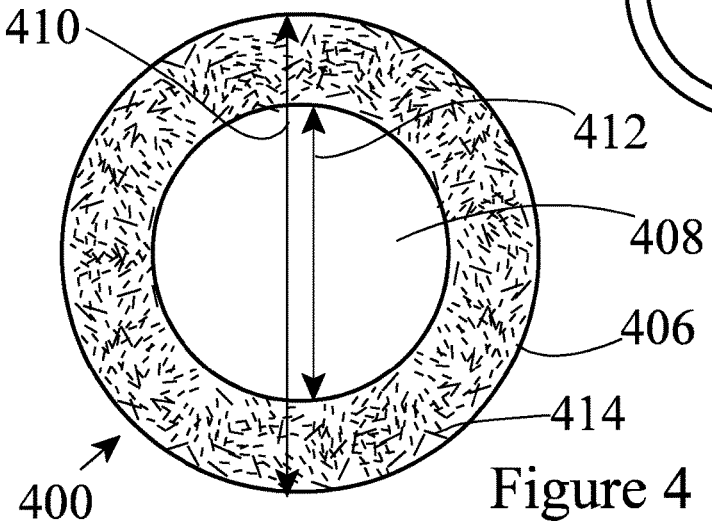
Figure 4

MAGNETIC AMMUNITION FOR AIR GUNS AND BIODEGRADABLE MAGNETIC AMMUNITION FOR AIRGUNS

RELATED APPLICATION(S)

This application claims the priority and benefit of previously filed U.S. patent application Ser. No. 14/449,550, in the name of James N. Marshall, filed on Aug. 1, 2014 and entitled "MAGNETICALLY-CHAMBERED FULLY AUTOMATIC AIR GUN" for which the entire disclosure is incorporated herein by this reference.

FIELD OF THE INVENTION

This invention relates generally to ammunition and projectiles, such as are found in class 102 of US Classification Index, and more specifically to ammunition for air guns having magnetic chambering of rounds.

BACKGROUND

Simplicity in the mechanical action of a weapon is extremely important, and so it is frequently true that a weapon is considered an advance over previous models because it simplifies the action.

In addition, air guns present some notable advantages over gunpowder weapons, however, air guns also tend to suffer from the problem of overly complex actions. For example, a typical low end lever-action air gun might generate a muzzle velocity of only 275 FPS (85 m/s), and require half a minute to pump up, even though it has numerous moving parts such as a piston, the lever, the lever arm, block, and so on.

Various weapons have used magnetic forces in their actions in various manners. However, these weapons all have more or less traditional actions, which use magnetism merely as an adjunct to some form of mechanical action.

An air gun has been invented, in the parent application to this application, which has as few moving parts as possible in the action, preferably none at all. It has the ability to fire at full automatic, and yet generate, in embodiments, muzzle velocities similar to those of gunpowder weapons.

It is possible to design ammunition specifically tailored to this unique new type of weapon.

Such ammunition would not be similar to that for a rail gun (a gun using magnetic forces to accelerate the rounds). Such weapons are enormous, heavy, expensive, and in fact not yet working in any practical manner outside of the laboratory. The enormous muzzle velocities generated by rail guns render the ammunition they use automatically fatal, the enormous recuperation energy required between shots renders them extremely slow to fire.

The air gun of the parent application on the other hand develops more or less normal muzzle velocities comparable to a low-power gunpowder weapon and fires more rounds per minute than any known air gun. The motive force is provided by a large reservoir of compressed air, not magnetism. Magnetic forces are used in place of a breech block.

Thus appropriate ammunition for the weapon will be small, light, inexpensive, ferrous (meaning magnetically responsive, not necessarily iron based), and since the magnetically chambered action of the air gun does not handle rounds individually, it will also be spherical.

Cost of ammunition is a growing issue and for a gun, such as that gun of the parent application (whose full disclosure is incorporated herein by reference) which fires a simply enormous amount of ammunition, ammunition cost is an extremely significant expense. While the material for a single round of ammunition may be bought at pennies in bulk, a gun which fires (as taught by the parent application) at a cyclic rate of 10,000 RPM or higher will rapidly run up the cost of even inexpensive ammunition due to sheer quantity. Thus it would be preferable to provide an inexpensive material for ammunition for air guns, especially for magnetically chambered airguns.

Spent ammunition is further becoming an issue. For example, depleted uranium core ammunition (prized for armor piercing rounds due the very high density of uranium) is only mostly depleted: the uranium remains slightly radioactive. Worse, uranium is itself a poison in the non-radiation sense. When such rounds are fired, an environmental issue can be created. Similar issues apply to other types of ammunition, even lead in old style small arms ammunition, which is a well-known environmental contaminant and so on and so forth. It would be preferable to provide materials for ammunition which are less prone to contaminating the environment.

It would further be preferable if the ammunition provided a ready means for customization close to the end user.

SUMMARY OF THE INVENTION

The present invention teaches a spherical round of ammunition for an air gun which uses a magnetic chambering system instead of a block. The round is therefore magnetic in whole or in part. In general, the round may be a single material, however a layered construction is preferred in the presently preferred embodiment and best mode now contemplated for carrying out the invention: in general, either a shell or mantle is disposed over either a core or a hollow void able to receive the user's choice of materials.

In embodiments, the invention may have a core which has over it a mantle. The core may be a magnetically influenced/magnetically responsive material such as a ferrous metal, while the mantle may be a foam or the like which provides a better degree of protection and impact absorption compared to traditional "rubber bullets". Thus, a non-lethal round may be provided, the effect of which is accentuated by the extremely high rate of fire of the magnetically chambered air gun (up to 10,000 rounds per minute cyclic rate has been achieved in testing) and yet is not deadly due to the rate of fire and muzzle velocity being adjustable anywhere from extremely low up to extremely high.

In other embodiments the mantle or shell may be made of plastic, infused with numerous small particles of a magnetically influenced material, for example iron filings or the like.

In other embodiments the actual caliber of the round may be varied greatly. Smaller rounds such as the traditional caliber of approximately .177 or the like may be used, however, the present invention and the gun which fires it is advantageous in that it can handle rounds up to the size of normal pistol rounds (40 caliber, 45 caliber) or in fact may handle rounds having calibers of 1 inch or more.

In embodiments, the device may have a hollow shell which is shipped for military or mobile use with nothing inside. The shell may be made of multiple parts, shipped nested but separated, so that they can be filled as needed. For example, a round of 1 inch caliber can easy be used with sand, even gravel, small explosives, propaganda materials, and so on and so forth. These "snap over anything" shells may have tabs, grooves, fasteners with matching detents and so on allowing the shell to actually fasten together by snapping into place. The hollow shell may be made of a ferrous material or other magnetically responsive material, or it may be a non-ferrous material, for example, iron versus plastic: both could be used in different embodiments.

In embodiments, the hollow shell may have a fill nipple and an internal bladder. The user may select a liquid to put into the bladder. In such embodiments, the device of the invention may have serrations in the shell (grooves such as an old fashioned "pineapple" grenade has) to allow easy fragmentation. The liquid used may itself be magnetically influenced or it may have something such as iron filings in the liquid.

In other embodiments the core may be a material such as iron filings, within a mantle or outer shell made of any non-magnetic material.

In yet other embodiments, the core may be itself a magnet as well, such as a rare earth magnet of neodymium or the like. In combination embodiments, a core of iron filings may have a rare earth magnet embedded within the iron filings.

In other embodiments (such as liquid casings) the magnetic influence may be on the outer shell/mantle rather than the inner material or core. Thus the round may be "outer influenced" or "inner influenced".

In one "outer influence round", the thick mantle may be of a polymer material or the like, which may be infused with iron filings or other ferrous materials or magnetically responsive materials so that the mantle, rather than the core, is magnetic.

In yet further embodiments both the core and the shell may be magnetically influenced.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

In other embodiments, the invention may be made of a biodegradable, recycled or refuse material. For example, the invention may be made of a paper mantle, with an iron core for magnetic influence. The invention may also be made of a paper mantle with an infusion of a magnetically responsive material such as iron fillings, iron waste particles, and so on. In other embodiments the core cavity may be coated with a thin liquid impermeable layer so as to prevent a liquid core (such as a paint or tear gas) from soaking into the paper mantle.

In yet other embodiments the mantle may be made of a powder, deeply compressed so as to maintain its structural integrity for a period of time prior to and during firing. After use, the powder mantle may disintegrate (for example, due to impact, due to weathering, water, etc) and the round may thus degrade away. Like many paper types, the powder of the mantle may be "true" biodegradable, that is, degraded by biological activity. Again, a magnetically influenced core may be used, or the core cavity may be coated with a liquid impermeable layer, and the magnetic responsiveness may be created by infusing into the powder mantle a material (such as iron filings) which is quickly degradable (uncoated iron breaks down rapidly when exposed to typical atmospheric conditions of humidity and temperature).

In yet other embodiments, the ammunition may be made of compressed refuse, such as compressed plastic, paper, etc. In particular, one common stage of recycling is the grinding or shredding of plastic or paper or the like into streamers or granules. Such partially recycled materials may advantageously be compressed into a mantle shape. If the mantle includes an infusion/component of magnetically responsive materials (ferrous or non-ferrous) then the interior may again be a cavity suitable for liquids. Note that if the mantle material is a non-absorbent material such as plastic, no interior coating may be necessary. In alternative embodiments, the compressed refuse core may be non-magnetically responsive but the core may be magnetically responsive, including either a ball of material such as iron, or a ball made of compressed magnetic refuse, that is, partially ground/or partially shredded metals of a ferrous or magnetic nature.

SUMMARY IN REFERENCE TO THE CLAIMS

It is therefore a first aspect, objective, embodiment and advantage of the present invention to provide a round of ammunition comprising: a spherical body, the body comprising at least two parts; the first body part being a core;

the second body part surrounding the core and being a mantle about the core, the second body part having an interior void into which the core may be disposed;

the second body part being made of two constituent materials, a first structural material which is non-magnetic and a second magnetically responsive material dispersed within the first structural material.

It is therefore a second aspect, objective, embodiment and advantage of the present invention to provide a round of ammunition, wherein the first structural material further comprising: a polymer.

It is therefore another aspect, objective, embodiment and advantage of the present invention to provide a round of ammunition, wherein the first structural material polymer further comprising: a shock absorbing polymer.

It is therefore another aspect, objective, embodiment and advantage of the present invention to provide a round of ammunition, wherein the second magnetically responsive material further comprises: particles of metal.

It is therefore another aspect, objective, embodiment and advantage of the present invention to provide a round of ammunition, wherein the particles of metal further comprise: iron filings.

It is therefore another aspect, objective, embodiment and advantage of the present invention to provide a round of ammunition, the core further comprises: a gas.

It is therefore another aspect, objective, embodiment and advantage of the present invention to provide a round of ammunition, the core further comprises: a metal.

It is therefore an objective, embodiment, aspect and advantage of the present invention to provide a round of ammunition manufactured by a manufacturing facility but for filling, loading and firing by an end user at a location other than such manufacturing facility, the round comprising: a spherical body, the body comprising at least two parts;

the first body part being a core loaded by such user;

the second body part surrounding the core and being a shell about the core, the second body part having an interior void into which the core may be disposed;

the second body part being made of a magnetically responsive material;

the second body part being comprised of a plurality of sections, the sections having fastening means by which the sections may be fastened to together about the core by such user.

It is therefore an objective, embodiment, aspect and advantage of the present invention to provide a round of ammunition wherein the fastening means further comprising: on a first one of the sections, a plurality of tabs, each tab having thereon at least one catch, on a second one of the sections, at least one detent, the detent dimensioned and configured to accept the catch into mechanical engagement, whereby the two sections are fastened together.

It is therefore an objective, embodiment, aspect and advantage of the present invention to provide a round of ammunition further comprising: a bladder disposed within the interior void;

a filling nipple passing through one of the sections in liquid communication with the bladder.

It is therefore an objective, embodiment, aspect and advantage of the present invention to provide a round of ammunition further comprising: a non-magnetic liquid within the bladder.

It is therefore an objective, embodiment, aspect and advantage of the present invention to provide a round of ammunition further comprising: a gas within the bladder.

It is therefore an objective, embodiment, aspect and advantage of the present invention to provide a round of ammunition further comprising: a plurality of fragmentation grooves whereby the shell may more easily fragment upon impact;

and further whereby the shell may absorb energy by means of fragmenting upon impact.

It is therefore yet another embodiment, aspect, objective, and advantage of the present invention to provide a round of ammunition comprising: a spherical body, the body comprising at least two parts;

the first body part being a core;

the second body part surrounding the core and being a mantle about the core, the second body part having an interior void into which the core may be disposed;

the second body part being made of a structural material which is non-magnetic;

the second body part being made of a material which is magnetically responsive.

It is therefore yet another embodiment, aspect, objective, and advantage of the present invention to provide a round of ammunition further comprising: a magnet disposed within the material of the second body part.

It is therefore yet another embodiment, aspect, objective, and advantage of the present invention to provide a round of ammunition wherein the magnet further comprising: a rare earth magnet.

It is therefore yet another embodiment, aspect, objective, and advantage of the present invention to provide a round of ammunition wherein the rare earth further comprises: Neodymium.

It is therefore yet another embodiment, aspect, objective, and advantage of the present invention to provide a round of ammunition wherein the material of the second body part further comprises: iron filings.

And it is therefore yet another embodiment, aspect, objective, and advantage of the present invention to provide a round of biodegradable ammunition comprising:

a spherical body, the body comprising at least two parts;

the first body part being a core;

the second body part surrounding the core and being a mantle about the core, the second body part having an interior void into which the core may be disposed;

the second body part being made of a first structural material which is biodegradable;

one part of the body being magnetically responsive.

And it is therefore yet another embodiment, aspect, objective, and advantage of the present invention to provide a round of biodegradable ammunition the first structural material further comprising one member selected from the group consisting of: paper, cellulose, wood fiber, saw dust, powder, polymer, recycled material, compressed materials, and combinations thereof.

And it is therefore yet another embodiment, aspect, objective, and advantage of the present invention to provide a round of biodegradable ammunition further comprising: a second magnetically responsive material dispersed within the first structural material, the second magnetically responsive material comprising one member selected from the group consisting of: iron filings, metal particles, recycled material, compressed materials, and combinations thereof.

And it is therefore yet another embodiment, aspect, objective, and advantage of the present invention to provide a round of biodegradable ammunition wherein the second part further comprises: a liquid impermeable barrier between the first and second parts.

And it is therefore yet another embodiment, aspect, objective, and advantage of the present invention to provide a round of biodegradable ammunition wherein the first part further comprises: iron filings, a metal sphere, metal particles, recycled material, compressed materials, and combinations thereof.

And it is therefore yet another embodiment, aspect, objective, and advantage of the present invention to provide a round of biodegradable ammunition wherein the first part further comprises: a liquid.

INDEX TO THE REFERENCE NUMERALS

| | |
|---|---|
| Magnetic round | 100 |
| Fragmentation groove | 102 |
| Liquid fill nipple | 104 |
| Magnetic round | 200 |
| Shell | 206 |
| Core | 208 |
| Caliber/diameter | 210 |
| Magnetic round | 300 |
| Shell | 306 |
| Core | 308 |
| Caliber/diameter | 310 |
| Magnetic round | 400 |
| Shell | 406 |
| Core | 408 |
| Outer diameter | 410 |
| Core diameter | 412 |
| Magnetically responsive material | 414 |
| Magnetic round | 500 |
| Shell | 506 |
| Core | 508 |
| Magnetic round | 600 |
| Shell | 606 |
| Core | 608 |
| Rare-earth magnet | 615 |
| Magnetic round | 700 |
| Shell half | 716a |
| Shell half | 716b |
| Interior | 718 |
| Tabs | 720 |
| Catch | 722 |
| Race | 724 |
| Detent | 726 |
| Magnetic round | 800 |
| Exterior fragmentation groove | 802 |
| Interior fragmentation groove | 804 |
| Interior | 918 |
| Bladder (empty) | 928 |
| Magnetic round | 1000 |
| Bladder (half full) | 1028 |

-continued

| INDEX TO THE REFERENCE NUMERALS | |
|---|---|
| Paper round | 1100 |
| Magnetically attracted compressed paper mantle | 1106 |
| Liquid proof interior coating | 1104 |
| Interior (liquid payload) | 1102 |
| Self-sealing fill ports | 1202 |
| Compressed powder mantle | 1302 |
| Iron/filing core | 1304 |
| Compressed powder round | 1400 |
| Interior/cavity/liquid | 1402 |
| Compressed powder with Iron infusion mantle | 1404 |
| Iron (particle/filing) | 1406 |
| Compressed refuse round | 1500 |
| Iron core/compressed magnetically responsive refuse core | 1502 |
| Compressed refuse mantle | 1504 |
| Compressed refuse iron infused round | 1600 |
| Compressed refuse mantle | 1604 |
| Iron infusion | 1606 |

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 2 is a cross-sectional view of a second embodiment of the invention.

FIG. 3 is a cross-sectional view of a third embodiment of the invention, showing a different caliber but with the same shell thickness as the previous embodiment.

FIG. 4 is a cross-sectional view of a fourth embodiment of the invention showing a different shell thickness and construction.

DETAILED DESCRIPTION OF EMBODIMENTS

Glossary

Figure 1:
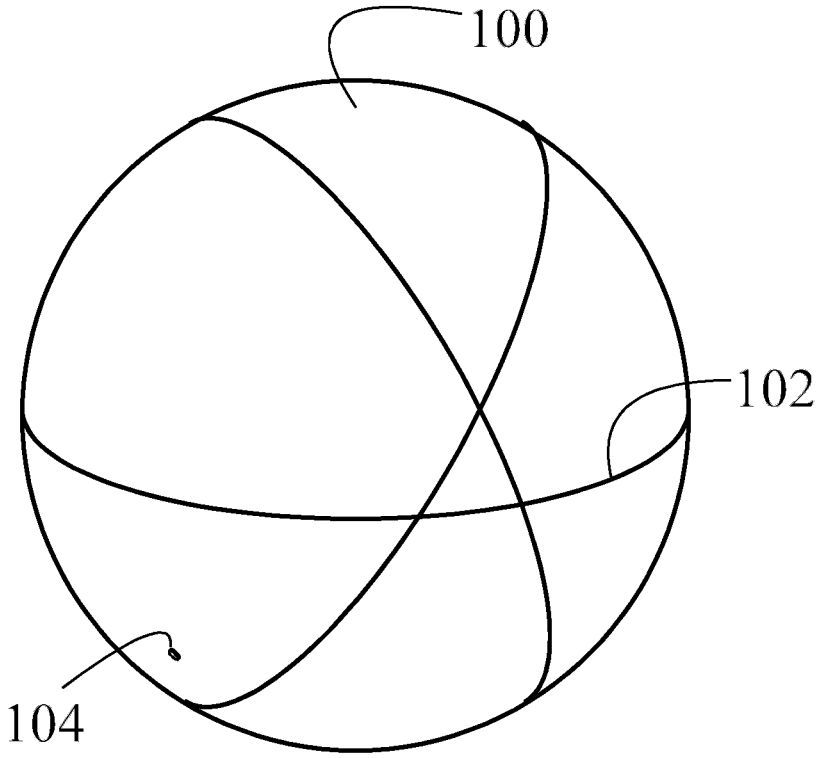
FIG. 1 is an oblique elevated orthogonal exterior view of a first embodiment of the invention.

For purposes of this application, "magnetic materials" refers to materials having a magnetic retentivity sufficient to allow it to generate, at least temporarily, a magnetic field, also called "magnetic flux". Magnets are themselves made of magnetic materials. "Magnetically responsive" materials, on the other hand, will respond when in a magnetic field, thus, steel ball bearings are an example of a magnetically responsive material. "Ferrous", on the other hand, refers to the presence of iron materials (since iron is the most common magnetic and magnetically responsive material), and the while the term is often used as a synonym for "magnetic materials" or "magnetically responsive materials", in this application it refers to the presence of iron. There are non-ferrous magnetic materials, for example, rare-earths and electromagnets can both be free of iron and yet magnetic.

The word "shell" as used herein, particularly in regard to the claims, does NOT refer to a "cannon shell" (a cannon projectile). The word "shell" means a mantle, covering, exterior integument or the like, thus a clam has a shell as used herein. The words "round" or "projectile" or the like will be used as needed and the word shell will not be herein used nor taken to indicate or refer to a projectile.

The word "biodegradable" in this application may mean either "true" biodegradability, that is, something which is degraded by actual biological action such as digestion, enzymatic action, etc, or the word may refer to the broader concept of something which degrades under natural conditions. Such degradation may be erosion (for example, a mantle of compressed powder may erode away much like adobe erodes in time) or due to solar radiation (many polymers decay under radiation) or due to the presence of oxygen (ditto), hydration (for example, paper products) and so on and so forth. The term "recycled" as used herein as the ordinary meaning that something which was already used in a product may be reused with a variable degree of processing. In the present application, the term "recycled" may specifically include something being shredded, split, shaved, drawn into streamers, reduced, dissolved, pulverized, ground up, granulated or otherwise reduced to small component pieces or particles which may then be used, especially when compressed together. "Compressed" particles/streamers, etc may refer to simple mechanical compression until mechanical co-adhesion of the particles is achieved or it may refer to a sintering process or the like.

The term "refuse" as used herein may refer to actual waste/garbage or it may simply refer to industrially uneconomical products or byproducts of other processes. For example, "flashing" from injection molding may be present in large quantities and may be contaminated by passing through the first manufacturing process so that it has no economical use. On the other hand, actual garbage may be used. "Recycled" materials (see previous paragraph) are desirable as the shredding or other partial processing of the materials will usually render them more suitable for compression and reuse as structural material for a bullet mantle.

In particular, wood products, paper products, and plastic products are anticipated to be good matches for mantle material (the first part of the round) while metal materials are anticipated to be useful as the magnetically responsive part of the round of ammunition, either in the core of the round or in the mantle as an infusion.

The word infusion as used herein may refer to an actual chemical infusion or it may simply refer to having pieces of something spread throughout something else: the word "dispersed" is used as a synonym.

End Glossary

FIG. 1 is an oblique elevated orthogonal exterior view of a first embodiment of the invention. This embodiment of the round 100 features a hollow shell having fragmentation grooves 102 which are designed to break upon impact. This not only absorbs more energy—which is desirable in non-lethal applications—it also allows the round to disperse a liquid or gas interior, such as tear gas or the like.

Liquid fill nipple 104 may be recessed, as shown. One advantage of the present invention, discussed later, is the ability for the user to fill the round themselves, using the fill nipple 104.

Since the round is fired from an air gun, the shell need not be as strong as the thick walls of a typical gunpowder round. This is due to a sometimes lower muzzle velocity but more due to the gentle nature of the acceleration in the gun design (see the parent patent incorporated herein by earlier reference) which does not use any breech block of any type.

Since the block-less action relies on magnetism, it is necessary that the round has at least one magnetically responsive component, either the shell/mantle or the core within. In this embodiment, the shell may be plastic if the liquid within is magnetically responsive or has magnetically responsive particles suspended therein. The shell may be metallic and magnetically responsive, such as ferrous metal, in which case the core need not be.

FIG. 2 is a cross-sectional view of a second embodiment of the invention. Magnetic round 200 has a thin shell 206 which as noted earlier may be magnetic or not. Core 208 will contain almost anything from air, to metallic spheres, the explosive charges, nonlethal gas or liquid and so on. (Liquid is one of the possible ways to deliver tear gas and the like.)

Caliber/diameter 210 may be rather surprising, as the gun of the invention has been tested up to quite large calibers and may be susceptible to even larger ones. Based on testing, calibers of 100 (1 inch) are easily possible and larger calibers as well. For a user in the field filing the round up, this large size means that even materials like gravel, shot, sand, paint, defoliants and so on may be used with ease, not to mention propaganda, electronics for C3 and intel/recon roles and so on.

FIG. 3 is a cross-sectional view of a third embodiment of the invention, showing a different caliber but with the same shell thickness as the previous embodiment. Magnetic round 300 has a shell of the same thickness (see shell 306) as shell 206, but the overall outer diameter/caliber 310 is smaller. Testing confirms that rounds very small can be used. Core 308 loses a great deal of volume for the payload compared to larger calibers FIG. 4 is a cross-sectional view of a fourth embodiment of the invention showing a different shell thickness and construction.

Magnetic round 400 has a mantle/shell 406 which has a structural material component selected for strength, or desirable impact/energy absorption qualities (for example to reduce lethality) or the like. This may be any polymer, such as plastic, rubber, foamed plastic or rubber, and so on. Core 408 may be seen to be smaller than core 208 despite the same caliber 410/210. Thus core diameter 412 is smaller, and the distance from outer diameter 410 to core diameter 412 allows the shell/mantle to be thicker. Magnetically responsive material 414 may be any magnetically responsive material of choice, one obvious choice is a ferrous metal particle such as iron filings.

This is one major distinction between the invention and a typical rail gun round is this lack of a huge percentage of magnetically responsive material for magnets to grab and accelerate. A rail gun typically generates an enormous G force on a projectile as it accelerates it using magnetic forces. This projectile does not need large amounts of magnetically responsive material as it is not accelerated magnetically at all, it is merely chambered into line with the air pressure by action of a magnet and then is accelerated by air pressure.

Figure 5:
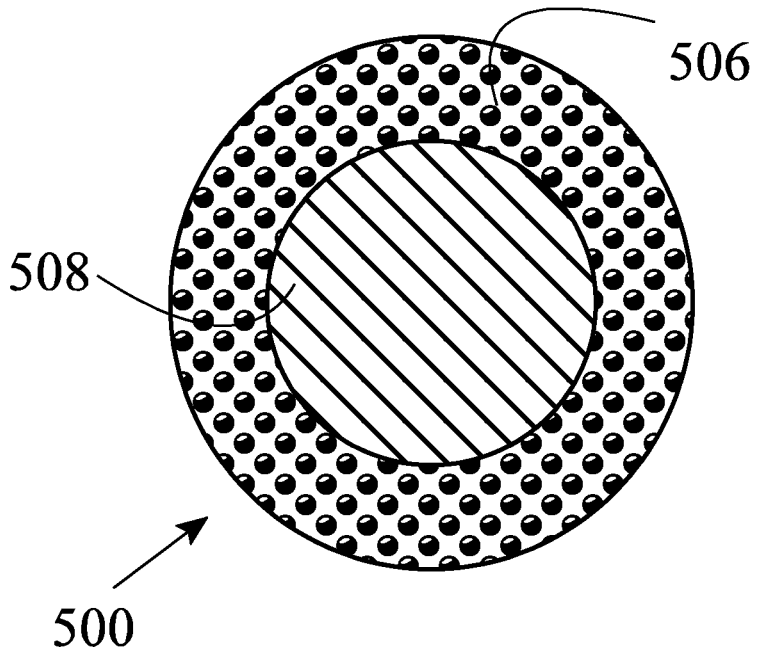
FIG. 5 is a cross-sectional view of a fifth embodiment of the invention, a non-lethal version with a foam outer casing.

FIG. 5 is a cross-sectional view of a fifth embodiment of the invention, a non-lethal version with a foam outer casing. Magnetic round 500 has a mantle/shell 506 which may be a foamed material, such as closed cell or open cell polymer, or another similar material.

Core 508 is in this embodiment the magnetically "grabable" part of the round, that is the part subject to the influence of magnetic forces.

This round is distinctly different from a "rubber bullet". Most rubber bullets are in fact normal metal bullets made slightly smaller than caliber and then coated with a very thin layer of extremely hard polymer. They feel more like steel than like rubber and have in fact been found to easily be lethal. The present invention on the other hand teaches that an air gun may accelerate a round which has a great deal less mass and a great deal more impact padding, in this case in the form of a thick mantle. The present invention is capable of inexpensively firing enormous numbers of rounds when compared to most infantry weapons firing "rubber bullets": as mentioned previously 10,000 RPM is achievable. The round gets its effectiveness not from nearly killing the target but rather from sheer overwhelming volume of fire.

Figure 6:
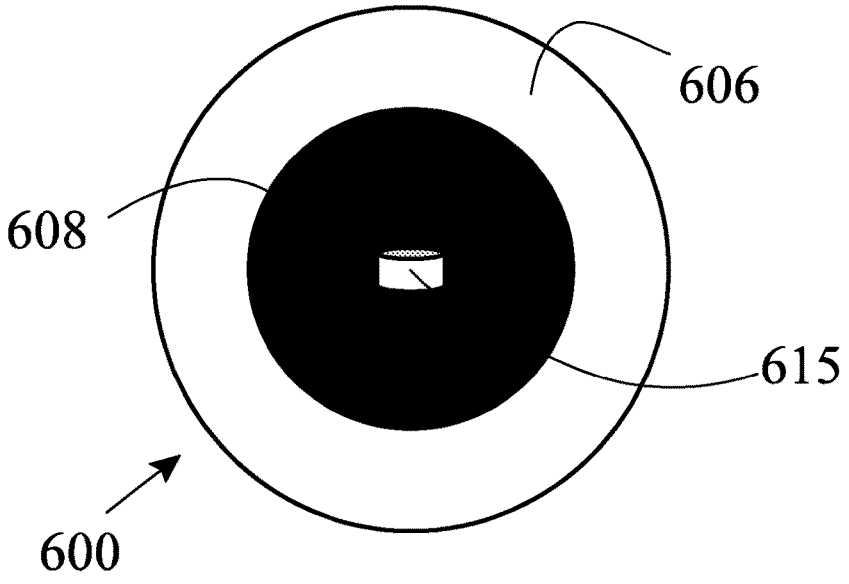
FIG. 6 is a cross-sectional view of a sixth embodiment of the invention with an iron-filing core or the like, and including an actual magnet rather than just incorporating a magnetically responsive material.

FIG. 6 is a cross-sectional view of a sixth embodiment of the invention with an iron-filing core or the like, and including an actual magnet rather than just incorporating a magnetically responsive material.

Magnetic round 600 may have a polymer shell 606 as the material of core 608 may be a magnetically responsive powder such as iron filings. In addition, a rare-earth magnet 615, for example a neodymium magnet, may be placed in the core as well.

Figure 7:
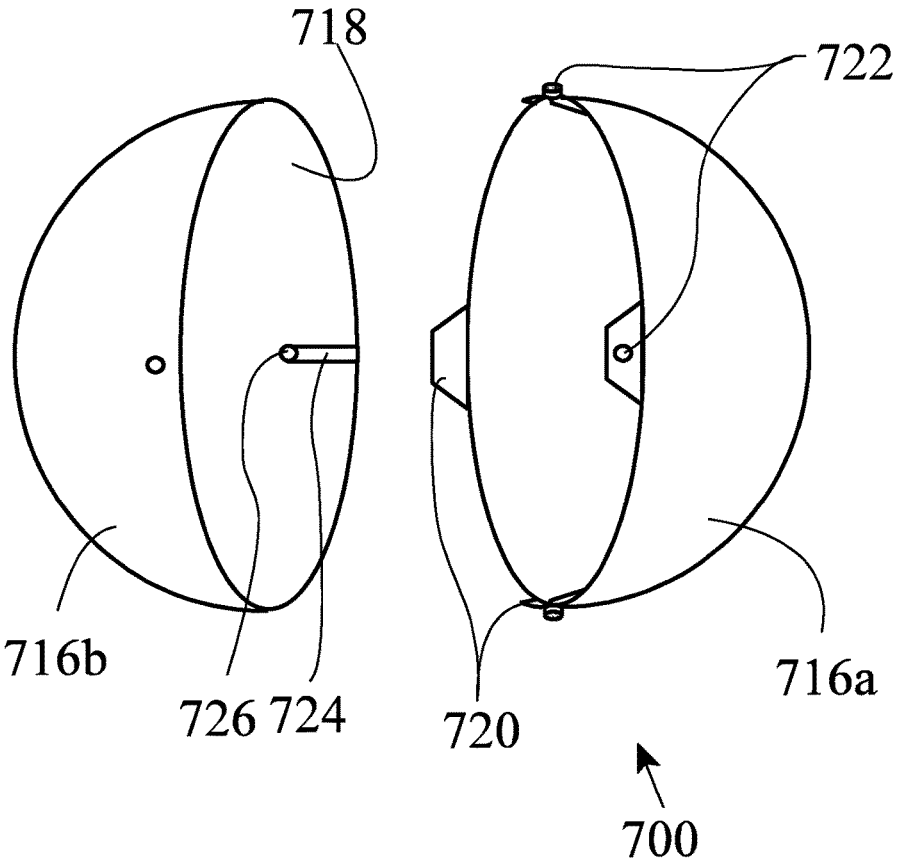
FIG. 7 is an elevated exploded view of a hollow round, showing details of fastenings suitable for use in the field and thus allowing field filling.

FIG. 7 is an elevated exploded view of a hollow round, showing details of fastenings suitable for use in the field and thus allowing field filling.

Magnetic round 700 has shell half **716*a* and shell half 716*b* which combine to form the complete shell when assembled. Interior 718** may be used to hold the desired core. This may be left empty if the shell is magnetically responsive, or if the shell is polymer or a non-ferrous metal, the core may provide the magnetic grip to the magnet in the gun's breech.

Tabs 720 may each bear at least one catch 722 which may be guided by race 724 to seat in mechanical engagement into dimples/detents/holes 726, thus securing the halves together. Again, this construction would probably fail in a gunpowder weapon of normal strength or a rail gun, due to the extreme accelerations of a gunpowder explosion right behind the round versus the onset of pressure in an open breech air gun.

In embodiments, each half might have one or more tabs and one or more detents, so that the halves may in fact be identical. By rotating one in relation to the other by a set number of degrees (90 degrees or the like) the two identical shell halves might then fit together.

The shell may be composed of more than two pieces, etc. Note that this particular round is designed for applications not requiring fragmentation grooves, perhaps solid cores, or the shell may be a very frangible polymer, etc.

Figure 8:
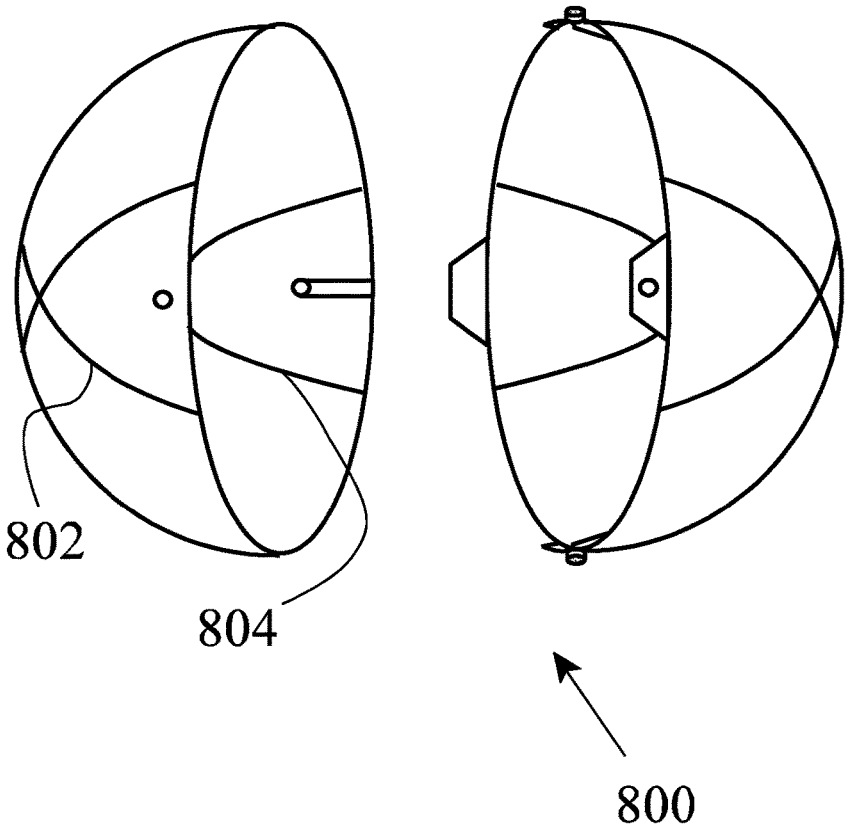
FIG. 8 is an elevated exploded view of a hollow round, showing details of fragmentation grooves.

FIG. 8 is an elevated exploded view of a hollow round, showing details of fragmentation grooves. Magnetic round 800 has both exterior fragmentation groove 802 and interior fragmentation groove 804, on respective outer and inner surfaces of the shell. These grooves allow the round to fragment, absorb energy, and release whatever the user has placed therein.

While the fragmentation grooves shown on inside and outside match in this case, there is no reason the invention is so limited. Also fragmentation grooves may be present only on the inner or outer surface instead of both (for example see FIG. 1) so as to reduce manufacturing cost. It is anticipated that rounds with fragmentation grooves will be used for liquid core applications, but it is not so limited.

Figure 9:
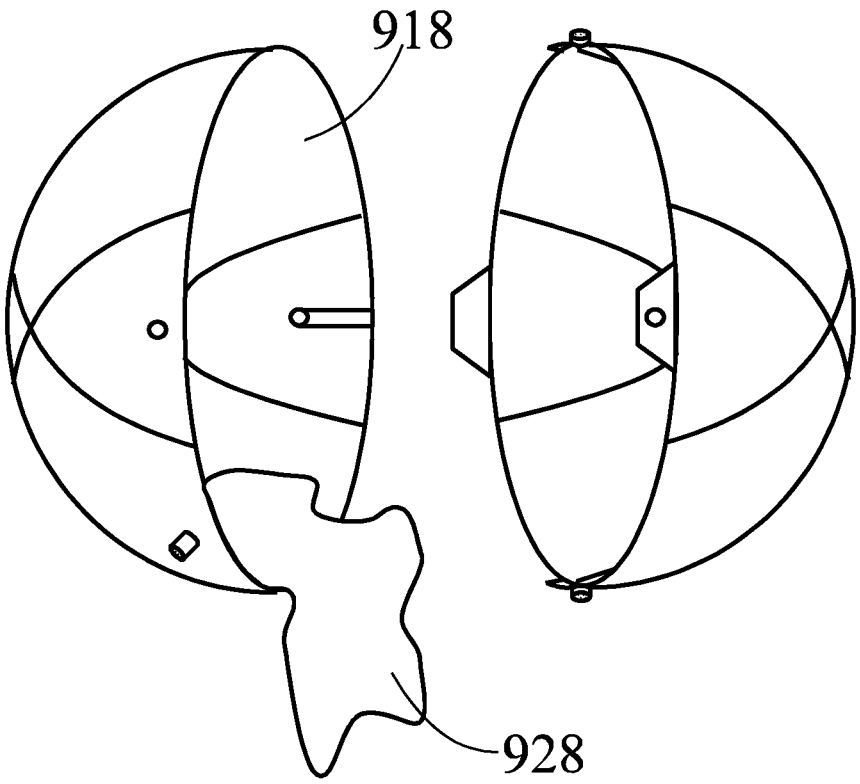
FIG. 9 is an elevated exploded view of a hollow round showing an empty bladder therein.

FIG. 9 is an elevated exploded view of a hollow round showing an empty bladder therein. Interior 918 has an empty bladder 928, shown dangling out for clarity but unlikely to actually do so in reality. The size of the fill nipple has been increased also for clarity, though it is unlikely to be that large.

It will be appreciated that the round may be shipped at very low cost to the end users or to intermediate fillers.

Figure 10:
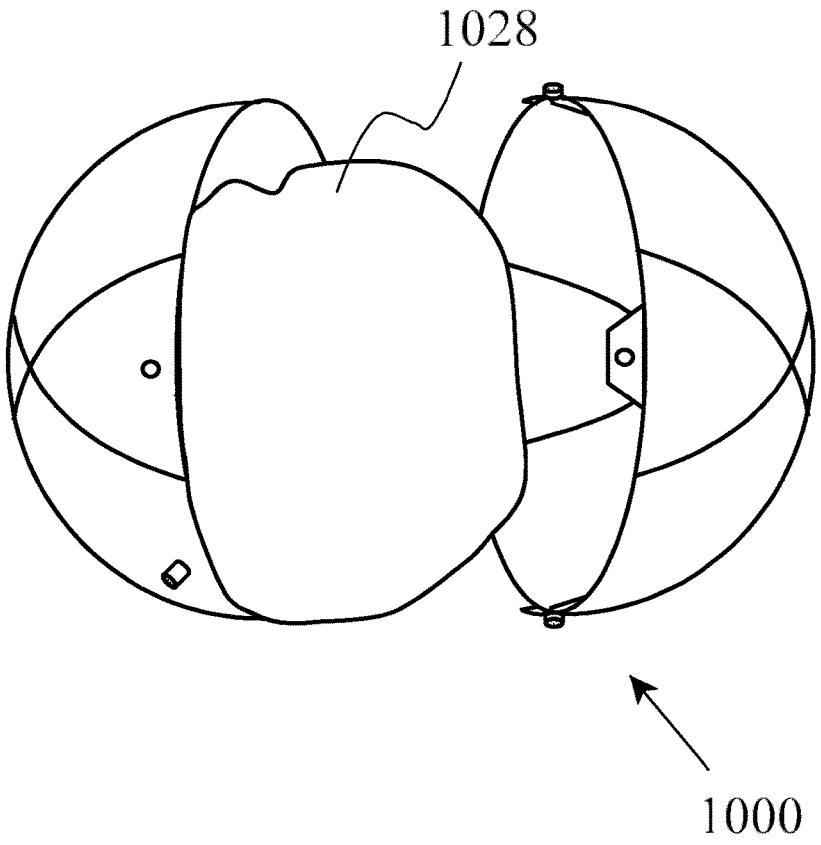
FIG. 10 is an elevated exploded view of a hollow round, for clarity disassembled half way through the act of filling the bladder.

FIG. 10 is an elevated exploded view of a hollow round, for clarity disassembled half way through the act of filling the bladder.

Magnetic round 1000 is shown with bladder 1028 half full, as in the process of filling, or if the user does not need to entirely fill the bladder. The bladder may contain gas or liquid, as desired. Note that the user could also leave the bladder empty and put a solid or particulate substance in the interior space, since the empty bladder takes up very little space.

Note that the round might be shipped assembled, or in embodiments not have two portions, and have the bladder already in place so the user could fill it without having to assemble it as well. Such embodiment would require more space for shipping.

The invention is also susceptible to a method embodiment in which a round is made unassembled, for example in two shell halves, and shipped empty and nested together. The user then fills the round with solid core material and then snaps it together, or snaps it together and fills it with liquid materials. The user then loads the round into a gun and fires it. By these steps the user can control the payload of the round.

Figure 11:
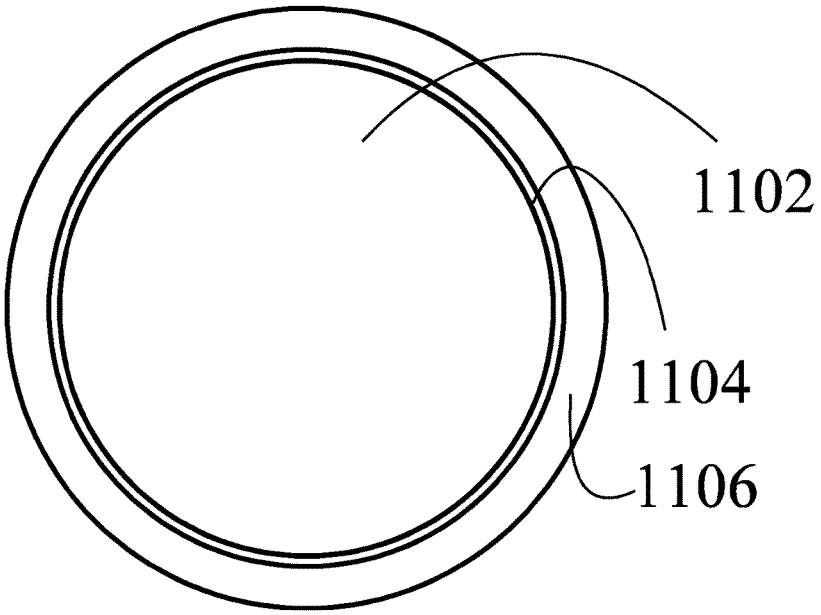
FIG. 11 is a cross-sectional view of a compressed paper round, with a magnetically infused mantle and a hollow core. The round has a liquid impermeable coating on the interior cavity.

FIG. 11 is a cross-sectional view of a compressed paper round, with a magnetically infused mantle and a hollow core. The round has a liquid impermeable coating on the interior cavity.

Paper round 1100 is again generally spherical. However, the magnetic chambering of the present invention allows, or in embodiments even relies upon, a greater degree of play between the ammunition and the various parts of the interior of the weapon. This in turn means that the ammunition need not be entirely round. In this context note that many types of conventional ammunition rely upon lands or other projections from the round the mechanically engage to grooves or even larger structures within the barrel of a weapon, thus gaining spin. The present invention merely uses this to provide a degree of manufacturing ease: the ammunition of the invention need not be perfect. This is helpful given that in certain embodiments the ammunition may be filled or assembled onsite (shell embodiments discussed previously), or even manufactured on site from recycled materials.

Magnetically attracted compressed paper mantle 1106 may be seen to be made of paper, for example, cardboard, carbon fiber, wood fiber, sawdust, carbon strands, woody stalk material from certain plants famous for woody stalks, and so on. The mantle may be magnetic due to the infusion/dispersion therein of magnetically responsive materials such as iron filings or the like.

Since the mantle may be magnetically responsive, no metallic core is necessary, which in turn means the device may be loaded with liquids (including in that term gases) such as tear gas, paint, dye, or the like.

Liquid proof interior coating 1104 may be a thin polymer, a lacquer previously applied, metallic, foil, etc etc. This interior coating may even be considered to be similar to the bladder previously discussed.

Interior (liquid payload) 1102 may be any of the substances previously discussed, including gases, gels, aerosols, and so on.

Figure 12:
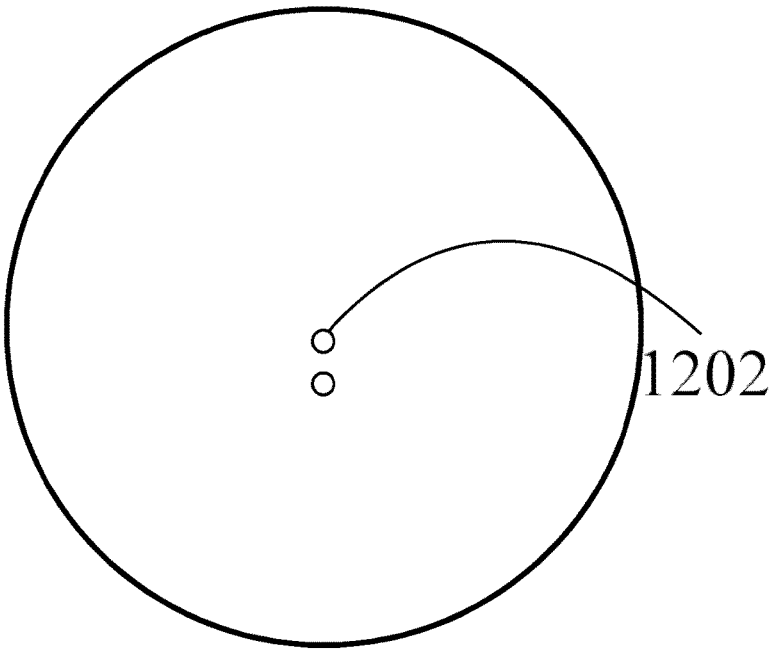
FIG. 12 is an exterior view of the compressed paper round, with a magnetically infused mantle and a hollow core, showing the sealable fill ports thereof.

FIG. 12 is an exterior view of the compressed paper round, with a magnetically infused mantle and a hollow core, showing the sealable fill ports thereof. As noted previously, the invention may be customizable at the scene of use, such as merchant ship or military outpost, by local choice of filling.

Self-sealing fill ports 1202 may be a simpler type than those of the first embodiment, instead the ports may simply be sealable. This can be a separate operation or the ports may be self-sealing, for example, by being made of a material which automatically compresses sideways into any small puncture and thus blocks it. One example of this is the compressed rubber of old style self-sealing fuel tanks, but other mechanisms may be used.

By means of the ports, the user may insert/inject a filling into the core with ease. A simple machine may be provided into which ammunition and liquid/gaseous filler is fed and from which filled ammunition rounds are ejected.

Figure 13:
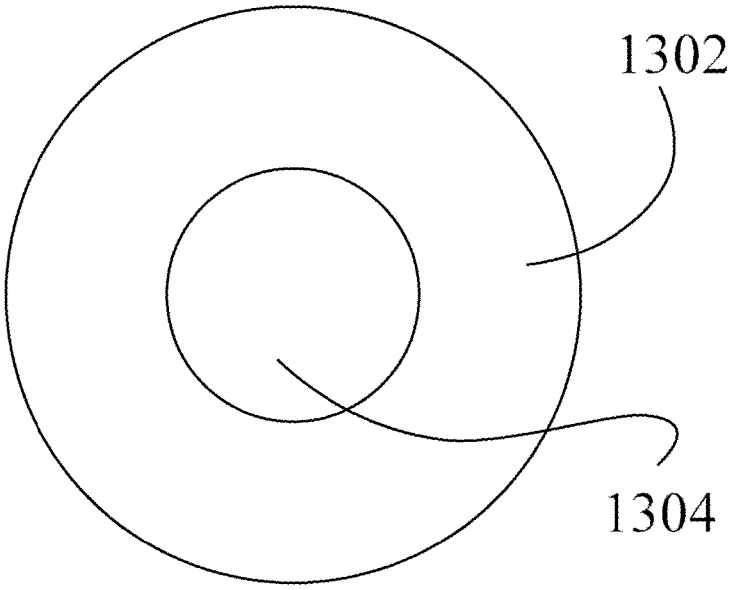
FIG. 13 is a cross-sectional view of a compressed powder round with an iron core.

FIG. 13 is a cross-sectional view of a compressed powder round with an iron core.

Compressed powder mantle 1302 may derive its structural integrity from compression only or the mantle may incorporate an agent which aids in binding, for example, an adhesive, a binder, or simply anything which causes a slight degree of melting followed by resolidifying of the constituent material or powder.

Iron/filing core 1304 of this embodiment provides the magnetic responsiveness to allow the "zero moving parts" chambering of rounds taught in the parent application hereto.

Figure 14:
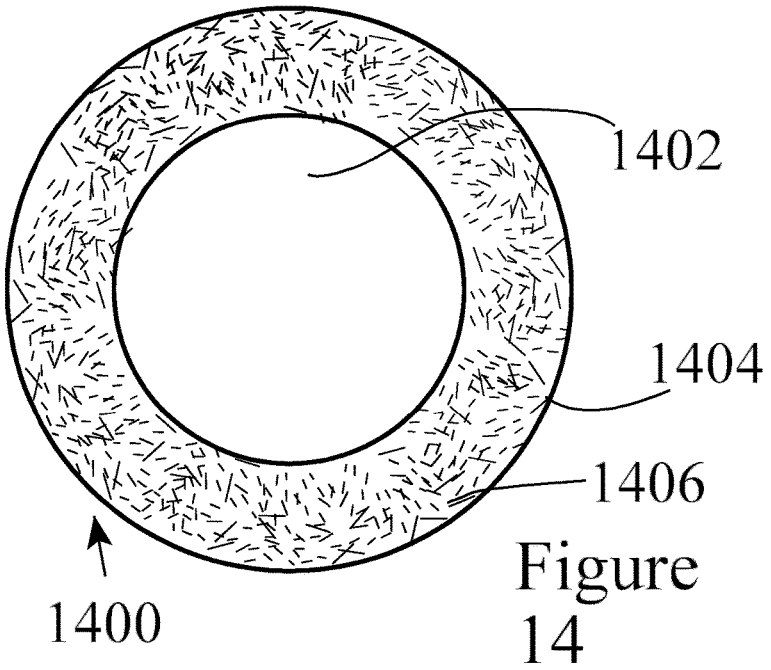
FIG. 14 is a cross-sectional view of a compressed powder round with a magnetically infused mantle and a payload cavity/core suitable for liquid.

FIG. 14 is a cross-sectional view of a compressed powder round with a magnetically infused mantle and a payload cavity/core suitable for liquid.

In this embodiment, it is possible to have both a powder mantle for extremely quick degradability and also to have a liquid core (first part) rather than a metallic core.

The benefit of certain powders is that they may degrade under conditions of low biotic activity. For example, in extremely cold areas it is common for normally biodegradable matter to survive almost indefinitely, in fact, even food stuffs can be found edible after extremely long periods of time. The same may apply in other biotically inert areas such as extreme deserts or the like. Powder however may degrade or at least fall apart back into particles ("biodegrade" under the broad definition of the Glossary) merely from the influence of solar radiation, wind, water, weather or the like.

Compressed powder round 1400 has a hollow interior/cavity which may contain non-lethal liquid/fluid 1402 such as tear gas or paint, or markers or the like. Obviously a liquid impermeable coating may be used as shown in a previous embodiment, or a bladder may be used as shown in other embodiments previously, fill ports or sealable ports and so on also being usable.

The round remains magnetically chamberable due to the compressed powder with a magnetic infusion used to make the mantle 1404. The magnetic infusion may be any of the materials previously discussed, such as iron (particles/filings) 1406. Once again, a certain small degree of deviation from the true round is permissible due to the flexible and simple design of the weapon which uses the ammunition.

Figure 15:
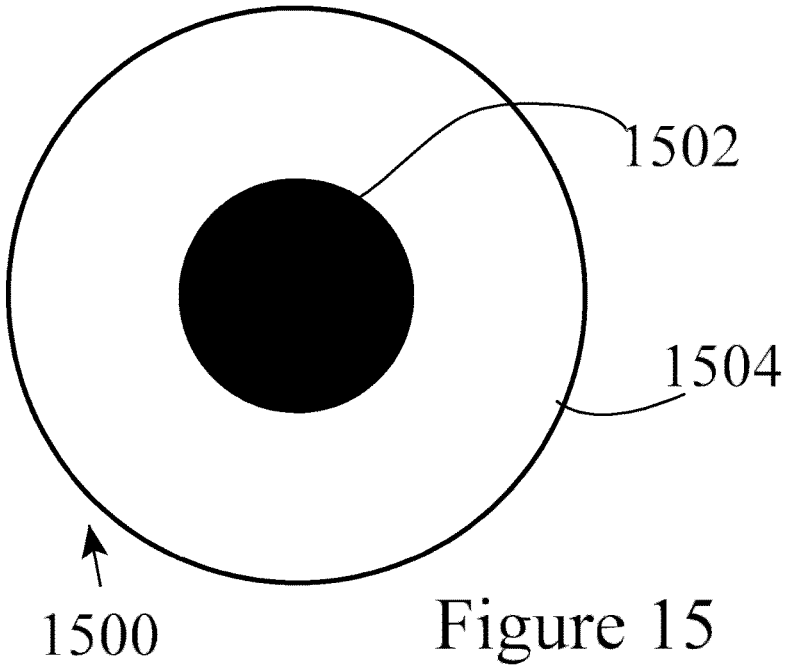
FIG. 15 is a refuse round made with an iron core or a core of compressed magnetically responsive refuse and a compressed refuse mantle which may or may not be magnetically responsive.

FIG. 15 is a refuse round made with an iron core or a core of compressed magnetically responsive refuse and a compressed refuse mantle which may or may not be magnetically responsive.

Iron core/compressed magnetically responsive refuse core 1502 may provide the magnetic responsiveness needed for operation of the air gun. It may be "found" refuse materials such as scrap metal of a ferrous nature.

Compressed refuse mantle 1504 may provide the cushioning, if desired, to non-lethal levels of impact, or may simply provide the desired caliber, weight or other factor to the round.

Since refuse as defined previously includes actual garbage and left over material from industrial processes, the invention may once again be susceptible to on the spot ammunition creation with fairly small and portable machinery.

Figure 16:
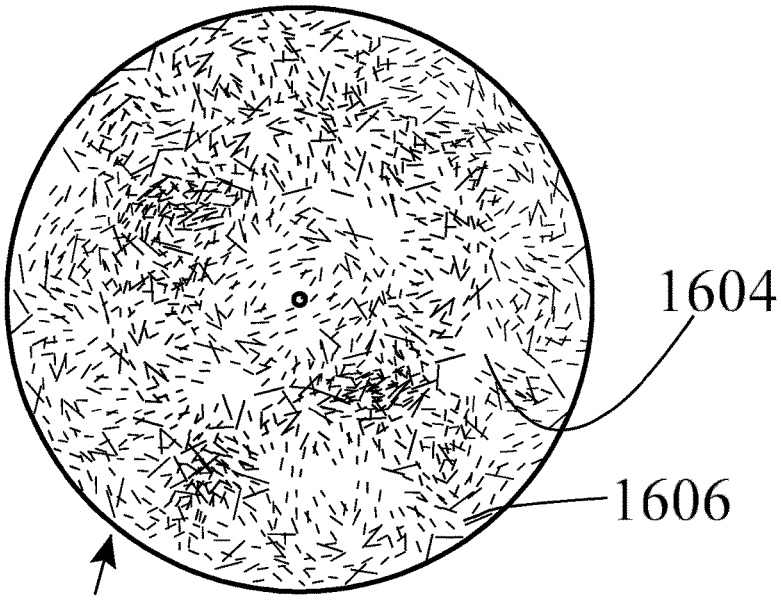
FIG. 16 is a refuse round made with a compressed refuse mantle containing magnetically responsive materials in the mantle and a cavity suitable for liquid.

FIG. 16 is a refuse round made with a compressed refuse mantle containing magnetically responsive materials in the mantle and a cavity suitable for liquid.

Compressed refuse iron infused round 1600 has an interior cavity in alternative embodiments but need not, as shown.

Compressed refuse mantle 1604 has iron infusion 1606 as discussed previously: iron filings or other useable magnetically responsive materials.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A round of ammunition comprising:

a spherical body, the body comprising a first body part and a second body part;

the first body part being a core;

the second body part surrounding the core and being a shell about the core, the second body part having an interior void into which the core is disposed;

the second body part being made of two constituent materials, a first structural material which is non-magnetic and a second magnetically responsive material dispersed within the first structural material; and a magnet disposed within a material of the first body part.

2. The round of ammunition of claim 1, the first structural material further comprising: a polymer.

3. The round of ammunition of claim 2, the first structural material polymer further comprising: a shock absorbing polymer.

4. The round of ammunition of claim 2, wherein the second magnetically responsive material further comprises: particles of metal.

5. The round of ammunition of claim 4, wherein the particles of metal further comprise: iron filings.

6. The round of ammunition of claim 2, wherein the core further comprises: a gas.

7. The round of ammunition of claim 2, wherein the core further comprises: a metal.

8. The round of ammunition of claim 1, wherein the second body part is comprised of a plurality of sections, the sections having fastening means by which the sections are fastened together about the core.

9. The round of ammunition of claim 8, the fastening means further comprising:

on a first one of the sections, a plurality of tabs, each tab having thereon at least one catch, on a second one of the sections, at least one detent, the detent dimensioned and configured to accept the catch into mechanical engagement, whereby the two sections are fastened together.

10. The round of ammunition of claim 8, wherein the shell further comprises:

a plurality of fragmentation grooves whereby the shell may more easily fragment upon impact;

and further whereby the shell may absorb energy by means of fragmenting upon impact.

11. The round of ammunition of claim 1, wherein the first structural material is biodegradable.

12. The round of ammunition of claim 11, the first structural material further comprising one member selected from the group consisting of: paper, cellulose, wood fiber, saw dust, powder, polymer, recycled material, compressed materials, and combinations thereof.

13. The round of ammunition of claim 11, wherein the second magnetically responsive material comprises one member selected from the group consisting of: iron filings, metal particles, recycled material, compressed materials, and combinations thereof.

14. A round of ammunition comprising:

a spherical body, the body comprising a first body part and a second body part;

the first body part being a core;

the second body part surrounding the core and being a mantle about the core, the second body part having an interior void into which the core is disposed;

the second body part being made at least in part of a structural material which is non-magnetic;

the second body part being made at least in part of a material which is magnetically responsive; and a magnet disposed within a material of the first body part.

15. The round of ammunition of claim 14, the magnet further comprising:

a rare earth magnet.

16. The round of ammunition of claim 15, wherein the rare earth further comprises:

Neodymium.

17. The round of ammunition of claim 14, wherein the material of the second body part further comprises: iron filings.

* * * * *